US009505473B2

(12) United States Patent
Kerins et al.

(10) Patent No.: US 9,505,473 B2
(45) Date of Patent: Nov. 29, 2016

(54) REMOTELY OPERATED VEHICLE INTEGRATED SYSTEM

(71) Applicant: Oceaneering International, Inc., Houston, TX (US)

(72) Inventors: Kevin Francis Kerins, Houston, TX (US); Peter Moles, Houston, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/522,260

(22) Filed: Oct. 23, 2014

(65) Prior Publication Data

US 2015/0112513 A1 Apr. 23, 2015

Related U.S. Application Data

(60) Provisional application No. 61/894,825, filed on Oct. 23, 2013.

(51) Int. Cl.
*B63G 8/00* (2006.01)

(52) U.S. Cl.
CPC ..... *B63G 8/001* (2013.01); *B63G 2008/007* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,167,831 | B1 * | 1/2001 | Watt et al. | 114/322 |
| 6,260,504 | B1 * | 7/2001 | Moles et al. | 114/312 |
| 6,390,012 | B1 * | 5/2002 | Watt et al. | 114/322 |
| 2009/0114140 | A1 * | 5/2009 | Guerrero et al. | 114/321 |
| 2011/0198092 | A1 * | 8/2011 | Machin et al. | 166/349 |

* cited by examiner

*Primary Examiner* — Thomas Tarcza
*Assistant Examiner* — Edward J Pipala
(74) *Attorney, Agent, or Firm* — Maze IP Law, PC

(57) ABSTRACT

A remotely operated vehicle integrated system comprises one or more remotely operated vehicles (ROV) configured to be deployed substantially continuously subsea and one or more a tether management systems configured to be deployed substantially continuously subsea. The ROVs and tether management systems are typically deployed substantially continuously subsea where a first signal interface, e.g. for power and/or data, is operatively connecting the signal source deployed substantially permanently subsea and one or more of the ROVs operatively connected the signal source.

20 Claims, 3 Drawing Sheets

REMOTELY OPERATED VEHICLE INTEGRATED SYSTEM

RELATION TO OTHER APPLICATIONS

This application claims priority U.S. Provisional Patent Application 61/894,825 filed Oct. 23, 2013.

BACKGROUND

Subsea functions, such as inspections and other functions, such are often required for structures disposed subsea such as on a blowout preventor (BOP) located subsea. Though often needed on demand, having a full-function remotely or autonomously operated vehicle available where and when needed is not always practical.

For example, remotely operated vehicles (ROV) are typically deployed subsea when and as needed but are often linked to a deploying ship by a tether management system, an assembly used to help deploy the ROV from the surface to the working depth. An ROV also typically requires an umbilical cable, usually an armored cable, that contains a group of electrical conductors and fiber optics to carry electrical power, video, and data signals between the operator and the tether management system. In the current art, a tether management system may be used in conjunction with an ROV for various purposes such as to pay a tether connected to the ROV in and out when the ROV reaches working depth. Typically, a tether management system is a garage-like device or cage which contains the ROV as the ROV is being lowered into the water or a separate top-hat like assembly which sits on top of the ROV as the ROV is being lowered into the water. Where used, the tether management system is used to relay the signals and power for the ROV down the tether cable. Once at the ROV, the electrical power is distributed between the components of the ROV.

A current art tether management system may comprise the ability to effect multiple functions such as lighting, an electronic control system, cameras, and an electro-hydraulic system to power various components during ROV deployment.

FIGURES

Various figures are included herein which illustrate aspects of embodiments of the disclosed inventions.

DESCRIPTION OF EXEMPLARY EMBODIMENTS

Figure 1:
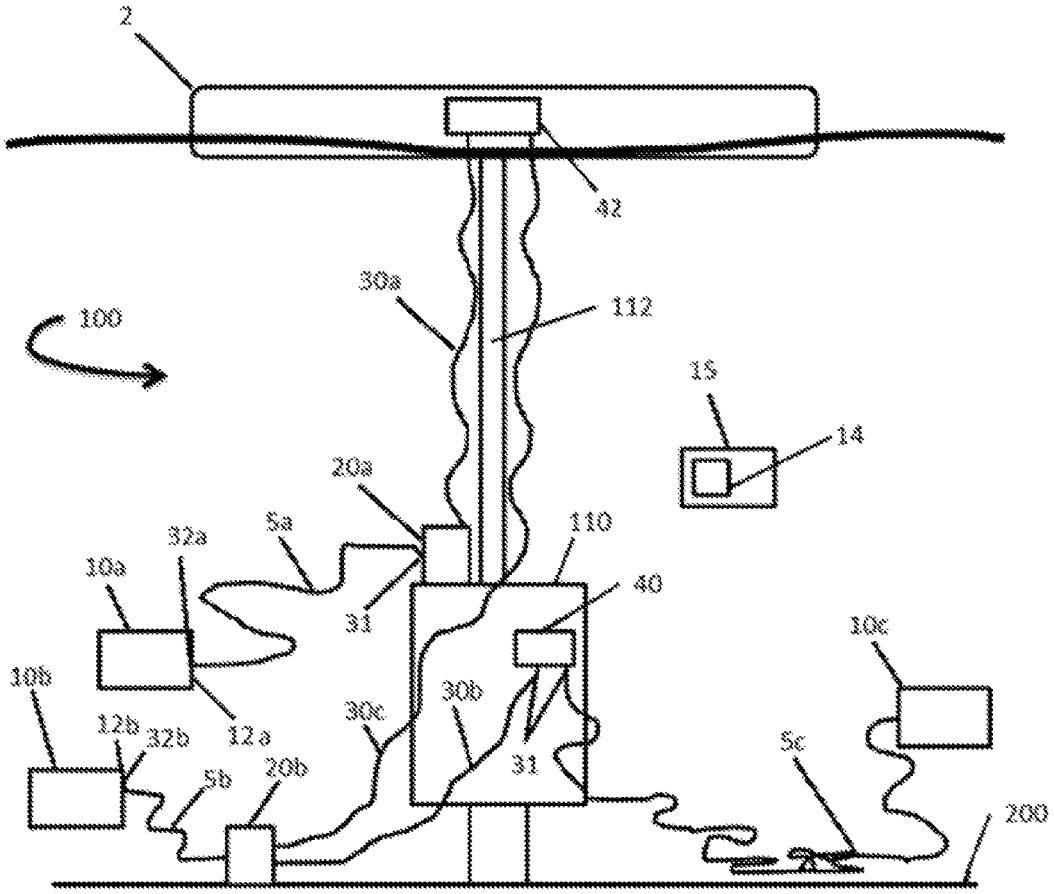
FIG. 1 is a schematic view of a first set of embodiments of a remotely operated vehicle integrated system.

Referring now to FIG. 1, remotely operated vehicle integrated system 100 comprises one or more remotely operated vehicles (ROV), generally referred to herein as "10" with separate ROVs designated as ROV 10*a*, ROV 10*b*, and/or ROV 10*c*, at least one of which comprises an ROV signal interface, generally referred to herein as "ROV signal interface 12, illustrated as 12*a* associated with ROV 10*a*, 12*b* associated with ROV 10*b*, and 12*c* associated with ROV 10*c*; and tether management system (TMS) 20 such as TMS 20*a* and/or TMS 20*b*. Both ROV 10 and TMS 20 are configured to be disposed and housed subsea substantially full time.

In embodiments, ROV 10 may be any appropriate ROV such as, but not limited to, a low power ROV such as a SPECTRUM® ROV; a light or medium work class ROV such as a MAGNUM PLUS® ROV, a heavy work class ROV such as Millennium PLUS ROV®, and/or an eyeball ROV such as a SEA MAXX SATELLITE ROV®, all of which are manufactured by Oceaneering International, Inc. of Houston, Tex. One of ordinary skill in the underwater ROV arts will recognize that an "eyeball" ROV can include observation class ROVs.

Typically, ROV 10 comprises an appropriately sized ROV whose power level requirements are low and whose video and communications may be satisfied using low powered devices and/or interfaces such as fiber optics, acoustics, and/or emitted light. In certain contemplated embodiments, ROV 10 may be an untethered ROV, e.g. ROV 13 (FIG. 2), or automated underwater vehicle 15 ("AUV"), and communicate using sound, light such as via light emitted diodes, or the like, or a combination thereof.

Referring still to FIG. 1, TMS 20 generally does not require a dedicated umbilical but, in currently contemplated embodiments, may tie into or otherwise connect to a portion or component of blowout preventor (BOP) 110 for power and/or data signals such as video or other data.

TMS 20 may be attached to, secured to, or otherwise connected to or part of BOP 110 such as TMS 20*a* or free-standing such as TMS 20*b*. TMS 20 may receive power and/or data signals via an umbilical, as illustrated at 20*a* and 30*a*. As discussed below, TMS 20 may comprise a cable and/or tether basket system (20*c* in FIG. 2). As will be apparent to those of ordinary skills in these arts, basket 20*c* (FIG. 2) may also comprise one or more sources 40.

In embodiments remotely operated vehicle integrated system 100 comprises an umbilical generally referred to as "30" with each ROV's associated umbilical referenced as 30*a*, 30*b*, and/or 30*c*, and one or more tethers generally referred to as "5," such as tether 5*a* and/or 5*b*, which further comprise first signal interface 31, configured to receive a signal from a signal source such as source 40 and/or source 42, and second signal interface generally referred to as "32" with associated tethers numbered similarly to an associated ROV 10, operatively in communication with first signal interface 31 and configured to interface with and supply the signal to ROV signal interface 12. In certain embodiments, umbilical 30*a* may be clamped to riser 112 and/or BOP 110. Umbilicals 30 and tethers 5 may be part of TMS 20.

Tether 5 is typically configured to receive power and/or data from source 40 and/or source 42 and allows for power and/or data to be supplied to and/or from ROV 10 such as via signal interface 12. Where the signal comprises a power signal, ROV signal interface 12 comprises a power signal interface; first signal interface 31 is configured to receive the power signal such as from signal source 40; and second signal interface 32 comprises a compatible, cooperative power signal interface configured to interface with and operatively connect to ROV power signal interface 12, thereby providing the power signal to ROV 10. Similarly, where the signal comprises a data signal, ROV signal interface 12 comprises a data signal interface; first signal interface 31 is configured to receive the data signal such as from signal source 40; and second signal interface 32 comprises a compatible, cooperative data signal interface configured to interface with and operatively connect to ROV data signal interface 12. In embodiments, signal source 40 supplies both power and data, where the data signal source may comprise a video data signal.

Figure 2:
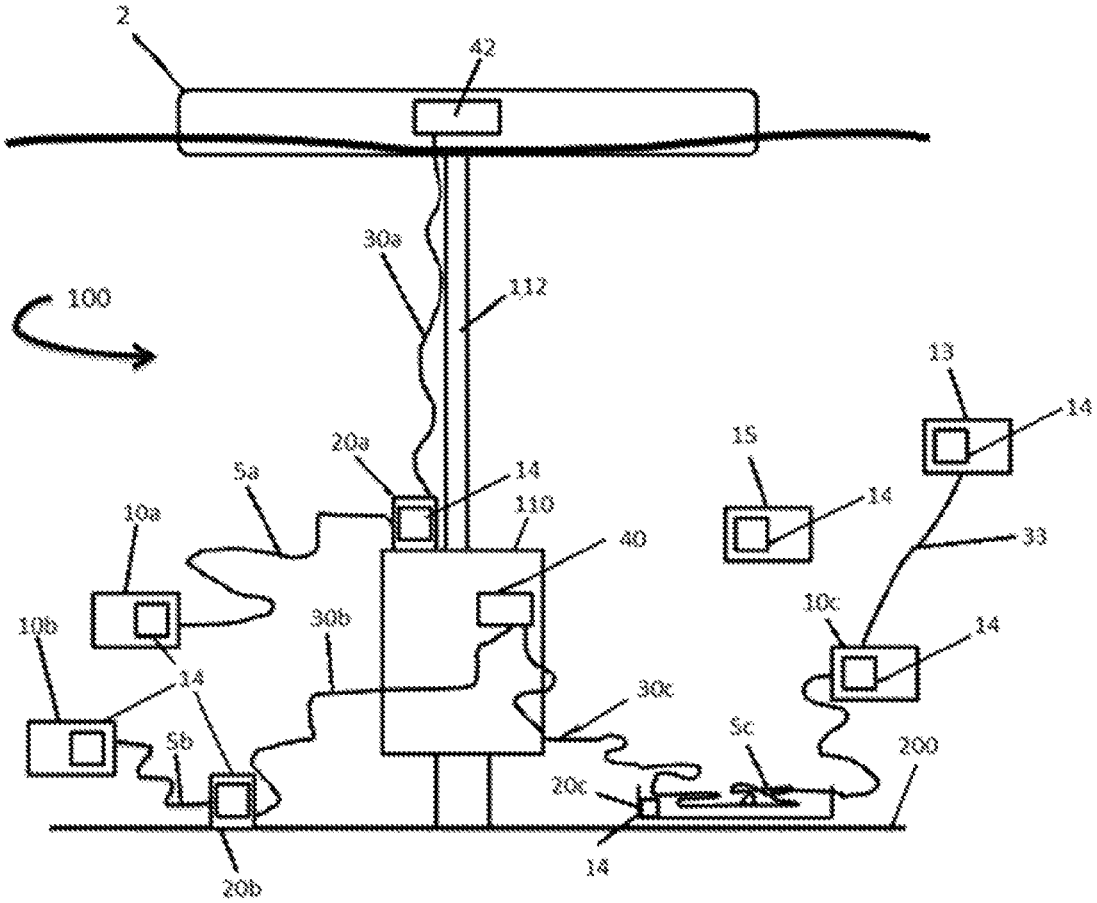
FIG. 2 is a schematic view of a various alternative power sources for the remotely operated vehicle integrated system.

Alternatively, a power source such as source 40 may be located on or near TMS 20, e.g. TMS 20*a* or 20*b*, or, as illustrated in FIG. 2, comprise power source 42 located distally from TMS 20 such as on vessel 2 and used to supply power to ROV 10.

In embodiments, umbilical 30 and/or tether 5 may be a lightweight umbilical or tether. In certain contemplated embodiments, either may be armored such as, but not limited to, with a low weight armor or not be armored at all.

In some embodiments, an umbilical may be an umbilical or tether comprising a strength member. By way of example and not limitation, the umbilical may be a low armored or non-armored umbilical or tether such as tether 5 which is only required to provided power and/or data. As used herein, and as will be apparent to one of ordinary skill in the subsea umbilical arts, armor may comprise an appropriate metal over wrapping used to protect a cable such as tether 5 and/or to provide tensile strength. However, with respect to tether 5, armor, if any is used, can comprise any strength member, located anywhere in or around tether 5, such as Kevlar and the like. In embodiments where umbilical 30*a* is clamped to riser 112 and/or BOP 110, a strength member may not be required for umbilical 30*a*.

Referring additionally to FIG. 2, ROV 10 may comprise or interface with a power source, either an on-board power source such as internal power source 14 (FIG. 2) or power supplied via tether 5 (FIG. 1, e.g. 5*a*, 5*b*, 5*c*), which provides power sufficient to fly and/or plug ROV 10 into and around BOP 110. In embodiments, power source 14 can comprise one or more fuel cells, batteries, or the like, or combinations thereof.

By way of example and not limitation, in alternative embodiments an ROV, such as ROV 10*c*, may free-line on internal power source 14 and/or free-line to sea floor 200 and interface with source 40 via tether 5*c*.

Referring still to FIG. 2, in embodiments where power source 14 is located on an ROV, such as ROV 10*a*, 10*b*, and/or 10*c* (FIG. 2), ROV 10, and, optionally, on a TMS, such as TMS 20*a*, 20*b*, or 20*c* (FIG. 2), may operate solely using power source 14 located on either or both of ROV 10 and TMS 20. If power source 14 comprises a battery, the battery may be trickle charged via an appropriate connection to umbilical 30; BOP 110, such as via a spare BOP power conductor; source 40; power source 42; ROV 13 (FIG. 2); ROV 15; or the like; or a combination thereof. By way of further example and not limitation, this may be accomplished via tether 5 and/or via ROV umbilical 33 (FIG. 2) via appropriate connectors. It will be noted that interfacing with source 40 which may be part of BOP 110 may be via a set of BOP spare lines rather than to BOP signal and power lines.

In certain embodiments, ROV 13 or AUV 15 may also be deployed substantially continuously subsea and untethered, receiving and/or providing data via acoustic communications, light, or the like. Free-flying ROV 13 and/or AUV 15 may be allowed to fly around until they need power, at which time they can dock with TMS 20 and/or BOP 110 and recharge their power supplies 14 via tether 5, umbilical 30, or the like, or a combination thereof. Once sufficiently recharged, ROV 13 or AUV 15 may resume operations including flying around and supplying power and/or data to other ROVs 10. In certain embodiments, power and/or control can be provided by a further ROV, such as ROV 13, e.g. via ROV umbilical 33. Where power source 14 comprises a battery, ROV 13 may provide for recharging power source 14, for example by trickle charging power supply 14 via ROV umbilical 33 via appropriate connectors.

In embodiments, umbilical 30 may be integrated into BOP 110 or riser umbilical, such as 30*a* which, in turn, interfaces with TMS 20, such as 20*a*; an umbilical which interfaces with source 40, such as umbilical 30*b*; into a separate umbilical, such as umbilical 30*c* which can be disposed along riser 112; and the like, or a combination thereof, where umbilical 30 is typically interfaced with TMS 20.

TMS 20, which is typically configured to be deployed substantially permanently subsea, may be connected or otherwise attached to a subsea structure such as BOP 110, as illustrated at 20*a*, or be free standing such as at 20*b*. In certain embodiments, TMS 20 comprises a full large type TMS such as 20*b*. In other contemplated embodiments, TMS 20 comprises a predetermined length of spooled tether such as at 5*c*. As illustrated in FIG. 2, TMS 20 may comprise basket 20*c* and a predetermined length of spooled tether such as at 5*c*.

Figure 3:
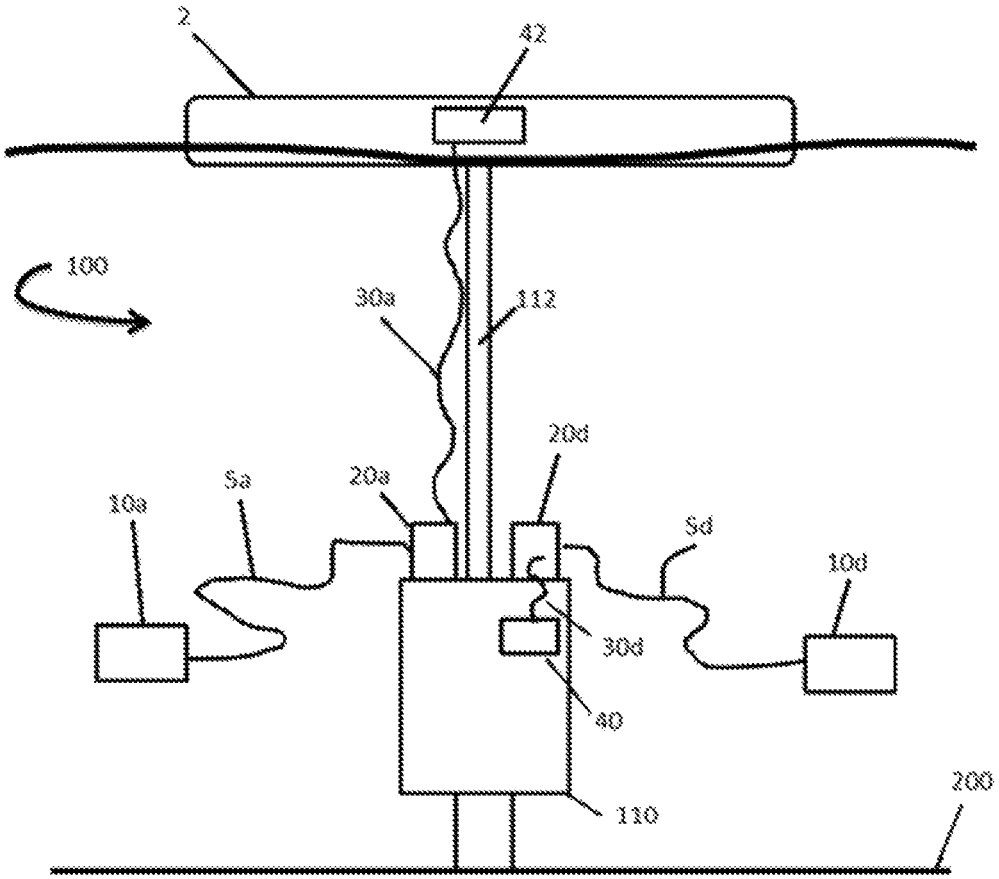
FIG. 3 is a schematic view of a further set of embodiments of the remotely operated vehicle integrated system.

In a further alternative, referring additionally to FIG. 3, ROV 10*d* may interface with tether 5*d* to TMS 20*d* which, in turn, interfaces with source 40, which is a component of BOP 110, to receive power and/or data signals from source 40, such as via umbilical 30*d*.

In the operation of preferred embodiments, referring generally to FIG. 1, one or more remotely operated vehicle integrated systems 100 are installed substantially continuously subsea and may interface directly into BOP 110. Installing multiple remotely operated vehicle integrated systems 100 can provide redundancy. Should one ROV 10 become troubled, e.g. ROV 10*a* becomes inoperative or broken down or stuck, a second ROV 10, e.g. ROV 10*b*, is immediately available for help. Second ROV 10*b* may be substantially identical to first ROV 10*a* or may be any ROV 10 which is compatible with remotely operated vehicle integrated system 100. One or more ROVs 10 may also be used to assist a work class ROV such as ROV 13 (FIG. 2) and/or AUV 15 should it suffer problems during a dive.

As they are deployed, substantially continuously subsea, remotely operated vehicle integrated systems 100 may be used to provide virtually immediate visual observation capability for subsea structures and would not require waiting on a work class ROV, such as ROV 13 (FIG. 3), to be deployed. Visual observation may include immediate visual observation capabilities for the BOP in high definition and/or in three dimensional high definition, typically via fiber optics.

If ROV 10 comprises an eyeball ROV, being small in nature an eyeball ROV could fly in close to a subsea structure, particularly in tight spaces, for specific observations including checking for leaks. As will be apparent to one of ordinary skill in the ROV arts, ROV 13 (FIG. 3), depending on its type and depending on the embodiment used, can be deployed via an umbilical such as a standard ROV umbilical, via a fastline such as a crane wire, fly freely within the water such as to a position proximate a sea floor, or the like.

One or more remotely operated vehicle integrated systems 100 may be deployed substantially continuously subsea. In typical embodiments, as described above ROV 10 is connected via tether 5 to receive power, data, or both from source 40, source 42, and/or ROV 13. Each ROV 10 is typically configured to provide one or more functions subsea, including but not limited to, valve actuation and position monitoring; bulls eye monitoring; general drilling operations monitoring, such as cuttings, concrete returns, and the like; BOP and/or drill head inspection; AX gasket inspection; spare ring placement; and general support to another ROV such as ROV 13, by way of example and not limitation, including supporting ROV 13 should it suffer problems during a dive or should there be adverse weather or other conditions which or preclude using ROV 13.

In any of the embodiments, remotely operated vehicle integrated system 100 may comprise two or more ROVs 10 and associated TMSs 20 configured substantially redundantly, all disposed substantially continuously subsea, such that each such ROV 10 and TMS 20 is further configured such that, should the first remotely operated vehicle integrated system 100 or ROV 10 become troubled or otherwise inoperative, e.g. broken down or stuck, the second remotely operated vehicle integrated system 100 and/or ROV 10 is immediately available for help.

It will be understood that various changes in the details, materials, and arrangements of the parts which have been described and illustrated above in order to explain the nature of this invention may be made by those skilled in the art without departing from the principle and scope of the invention as recited in the appended claims.

We claim:

1. A remotely operated vehicle integrated system, comprising:

a. a remotely operated vehicle (ROV) configured to be deployed substantially continuously subsea, the ROV comprising an ROV signal interface; and b. a separate tether management system configured to be deployed substantially permanently subsea, the tether management system comprising a tether, the tether comprising:

i. a first signal interface configured to receive a signal from a signal source; and ii. a second signal interface operatively in communication with the first signal interface and configured to interface with and supply the signal to the ROV signal interface.

2. The remotely operated vehicle integrated system of claim 1, further comprising an umbilical operatively in communication with the ROV signal interface and the signal source.

3. The remotely operated vehicle integrated system of claim 1, wherein:

a. the signal comprises a power signal;

b. the ROV signal interface comprises a power signal interface;

c. the first signal interface is configured to receive the power signal from the signal source; and d. the second signal interface comprises a compatible, cooperative power signal interface configured to interface with and operatively connect to the ROV power signal interface.

4. The remotely operated vehicle integrated system of claim 1, wherein:

a. the signal comprises a data signal;

b. the ROV signal interface comprises a data signal interface;

c. the first signal interface is configured to receive the data signal from the signal source; and d. the second signal interface comprises a compatible, cooperative data signal interface configured to interface with and operatively connect to the ROV data signal interface.

5. The remotely operated vehicle integrated system of claim 1, wherein the signal source comprises a non-dedicated signal source deployed substantially permanently subsea.

6. The remotely operated vehicle integrated system of claim 5, wherein:

a. the non-dedicated signal source deployed substantially permanently subsea comprises a current blowout preventor (BOP) power signal source and a data signal source;

b. the ROV signal interface comprises a power interface and a data signal interface;

c. the data signal source comprises a video data signal;

d. the first signal interface is configured to operatively connect to the current blowout preventor (BOP) power signal source and the data signal source; and e. the second signal interface comprises a compatible, cooperative power and data signal interface configured to interface with and operatively connect to the ROV power interface and the ROV data signal interface.

7. The remotely operated vehicle integrated system of claim 1, wherein tether management system is connected to a blowout preventor (BOP) infrastructure.

8. The remotely operated vehicle integrated system of claim 1, wherein tether management system is configured to be deployed substantially permanently subsea independent of any other subsea structure.

9. The remotely operated vehicle integrated system of claim 1, wherein the ROV comprises an eyeball ROV.

10. The remotely operated vehicle integrated system of claim 9, wherein the eyeball ROV comprises an onboard power source sufficient to fly the eyeball ROV to the BOP and allow the eyeball ROV to interface with the BOP.

11. The remotely operated vehicle integrated system of claim 1, further comprising an untethered remotely operated vehicle configured to be deployed substantially continuously subsea and operatively interface with the ROV.

12. The remotely operated vehicle integrated system of claim 11, wherein the untethered remotely operated vehicle is configured to receive and/or provide data via at least one of acoustic communications or light.

13. The remotely operated vehicle integrated system of claim 11, wherein:

a. the untethered remotely operated vehicle comprises a first internal power source; and b. the untethered remotely operated vehicle is configured to perform subsea and dock with the tether management system to recharge the first internal power source.

14. The remotely operated vehicle integrated system of claim 1, wherein either the ROV or the tether management system comprises a second internal power supply comprising a battery configured to be trickle charged via an umbilical, a source originating with the BOP, the signal source, and/or another ROV.

15. A redundant remotely operated vehicle integrated system, comprising:

a. a first system disposed substantially continuously subsea, comprising:

i. a remotely operated vehicle (ROV) configured to be deployed substantially continuously subsea, the ROV comprising an ROV signal interface; and ii. a tether management system configured to be deployed substantially continuously subsea, the tether management system comprising a tether, the tether comprising:

1. a first signal interface configured to receive a signal from a signal source; and 2. a second signal interface operatively in communication with the first signal interface and configured to interface with and supply the signal to the ROV signal interface; and b. a second system substantially identical to the first system, the second system disposed substantially continuously subsea and further configured such that the second system is immediately available if the first system becomes inoperative.

16. A method of providing a subsea device substantially permanently subsea, comprising:

a. deploying a first remotely operated vehicle (ROV) substantially continuously subsea, the first ROV comprising a first ROV signal interface;

b. deploying a separate first tether management system substantially permanently subsea to a first predetermined position subsea, the first tether management system comprising a first tether, the first tether comprising:

i. a first signal interface configured to receive a first signal from a first signal source; and ii. a second signal interface operatively in communication with the first signal interface and configured to interface with and supply the first signal to the first ROV signal interface;

c. operatively connecting the first signal interface to the first signal source;

d. operatively connecting the second signal interface to the first ROV signal interface;

e. sending the first signal to the first ROV when a predetermined function is to be performed; and f. receiving a second signal from the first ROV during the performance of the predetermined function.

17. The method of claim 16, further comprising:

a. deploying a second remotely operated vehicle (ROV) substantially continuously subsea to a second predetermined position subsea, the second ROV substantially identical to the first ROV;

b. deploying a second tether management system substantially continuously subsea, the second tether management system comprising a second tether, the second tether comprising:

i. a third signal interface configured to receive a second signal from a second signal source; and ii. a fourth signal interface operatively in communication with the third signal interface and configured to interface with and supply the second signal to the third ROV signal interface;

c. operatively connecting the third signal interface to the second signal source;

d. operatively connecting the fourth signal interface to the third ROV signal interface;

e. monitoring the first ROV; and f. if the first ROV becomes inaccessible or otherwise inoperative, using the second ROV to perform the predetermined function.

18. The method of claim 17, wherein the predetermined function is selected from a group of predetermined functions, including valve actuation and position monitoring; bulls eye monitoring; monitoring general drilling operations; BOP and drill head inspection; AX gasket inspection; spare ring placement; and general support to a work class ROV.

19. The method of claim 16, further comprising:

a. providing the first ROV or the first tether management system with an on-board power source, the onboard power source comprising a battery; and b. recharging the power source by trickle charging the power supply via an appropriate power source operatively connected to the battery.

20. The method of providing a subsea device substantially permanently subsea of claim 17, wherein the first predetermined position subsea and the second predetermined position subsea are selected from a group of positions subsea comprising a subsea structure or a location proximate a seafloor.

* * * * *